US011162757B2

(12) United States Patent
Peterson et al.

(10) Patent No.: US 11,162,757 B2
(45) Date of Patent: Nov. 2, 2021

(54) MUZZLELOADER WITH GAS POWERED EJECTION

(71) Applicant: Vista Outdoor Operations LLC, Anoka, MN (US)

(72) Inventors: Bryan P. Peterson, Isanti, MN (US); Drew L. Goodlin, Isanti, MN (US)

(73) Assignee: Vista Outdoor Operations LLC, Anoka, MN (US)

( * ) Notice: Subject to any disclaimer, the term of this patent is extended or adjusted under 35 U.S.C. 154(b) by 0 days.

(21) Appl. No.: 16/747,099

(22) Filed: Jan. 20, 2020

(65) Prior Publication Data

US 2020/0278170 A1 Sep. 3, 2020

Related U.S. Application Data

(60) Provisional application No. 62/794,700, filed on Jan. 20, 2019.

(51) Int. Cl.
*F41C 9/08* (2006.01)

(52) U.S. Cl.
CPC ..... *F41C 9/08* (2013.01)

(58) Field of Classification Search
CPC .... F41C 9/08; F41C 9/085; F41A 5/18; F41A 5/26
See application file for complete search history.

(56) References Cited

U.S. PATENT DOCUMENTS 5,824,943 A * 10/1998 Guhring ..... F41A 5/26 89/192
6,305,113 B1 * 10/2001 Calvete ..... F41A 17/56 42/41
2018/0321022 A1 * 11/2018 Peterson ..... F41A 9/375

FOREIGN PATENT DOCUMENTS

DE 1 008 154 * 5/1957

* cited by examiner

*Primary Examiner* — J. Woodrow Eldred
(74) *Attorney, Agent, or Firm* — Reed Smith LLP; Matthew P. Frederick; John M. Cogill

(57) ABSTRACT

A muzzleloader firearm for use with a projectile, a propellant containment vessel including a prepackaged propellant charge therein, and a primer. The muzzleloader has a stock and a barrel supported by the stock. The barrel has a breech end, a muzzle end, and a barrel wall extending in a forward direction from the breech end to the muzzle end. A breech plug is at the breech end. The barrel being ported to transfer expanding gases from the barrel to the breech plug. A gas passageway in the breech plug directs expanding propellant gases to the propellant chamber behind the propellant vessel seated therein wherein the expanding gases can eject the used propellant vessel.

8 Claims, 7 Drawing Sheets

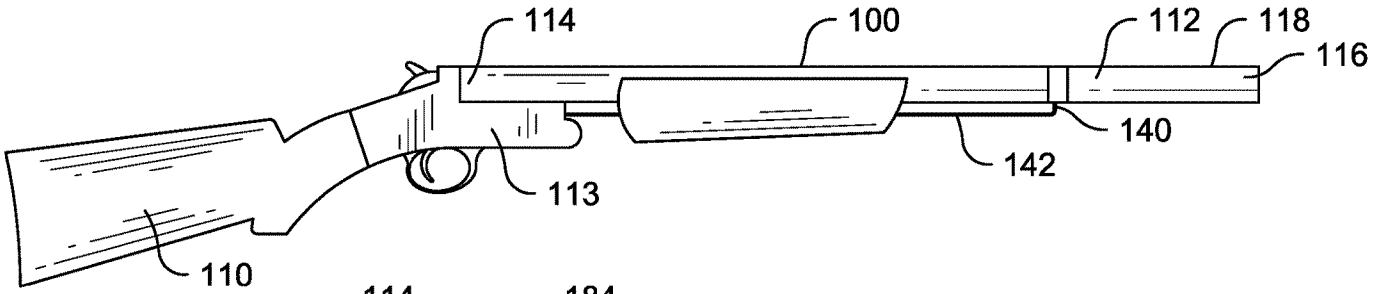
FIG. 1
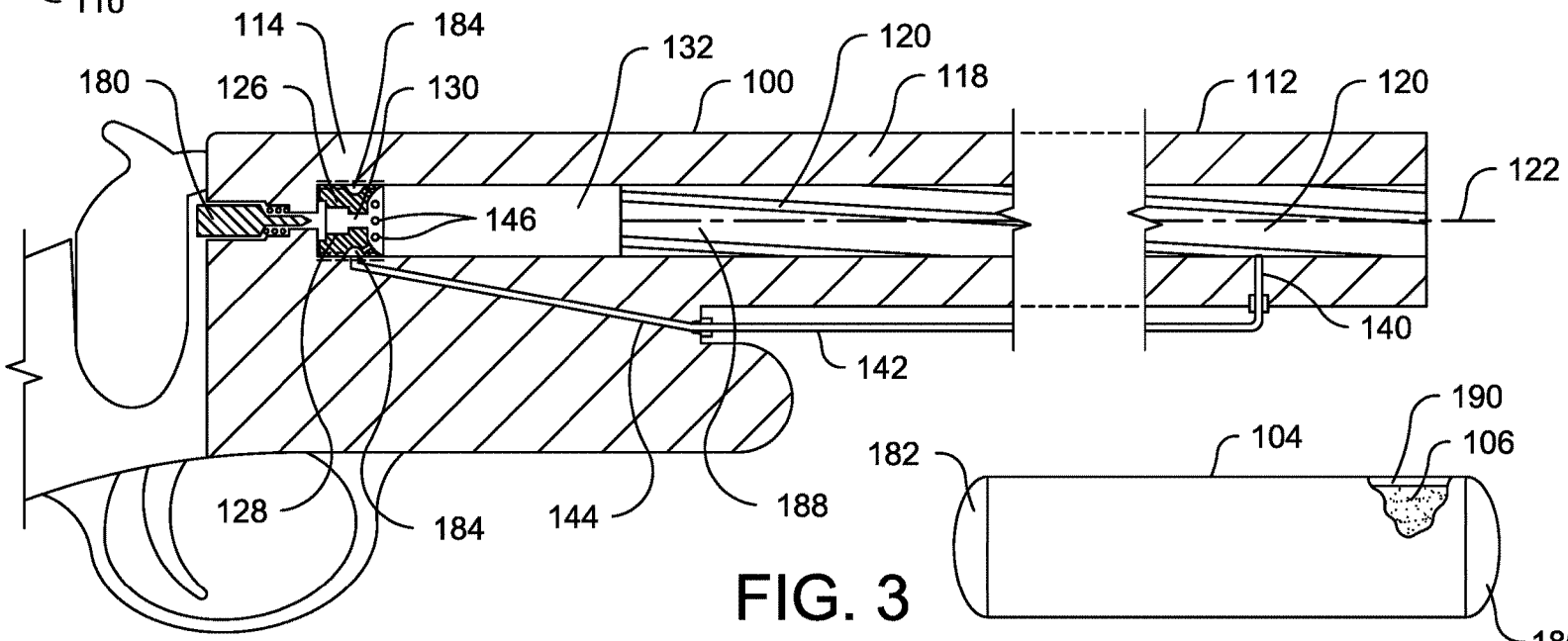
FIG. 2
FIG. 3
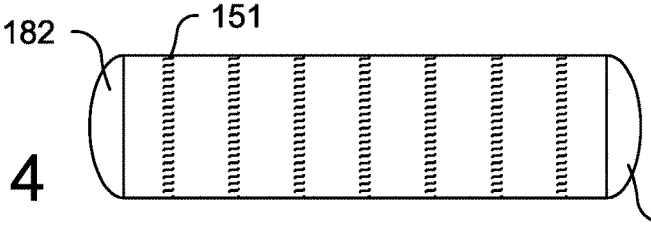
FIG. 4

MUZZLELOADER WITH GAS POWERED EJECTION

CROSS-REFERENCE TO RELATED APPLICATION

This application claims the benefit under 35 U.S.C. § 119(e) of the earlier filing date of U.S. Provisional Patent Application No. 62/794,700 filed on Jan. 20, 2019, the disclosure of which is incorporated by reference herein.

BACKGROUND OF THE INVENTION

Muzzleloaders are a class of firearms in which the propellant charge and bullet are separately loaded into the barrel immediately prior to firing. Unlike modern breech loaded firearms where the bullet, propellant charge and primer are loaded as prepackaged cartridges, many muzzleloaders are loaded by feeding a propellant charge through the muzzle of the barrel before ramming a bullet down the barrel with a ramrod until the bullet is seated against the propellant charge at the breech end of the barrel. A primer is inserted at the breech to be in communication with the propellant. The primer is then struck by an inline firing pin or an external hammer to ignite the propellant charge to create propellant gases for propelling the bullet.

A variability in muzzleloaders not present in cartridge based firearms is the quantity and type of the propellant charge. Unlike cartridge firearms where a cartridge is preloaded with a bullet and premeasured quantity of propellant is loaded into the firearm for firing, the bullet and propellant charge are combined within the firearm for firing. Accordingly, the muzzleloader operator can select the optimal bullet, propellant type and quantity combination for each shot, which is particularly advantageous given the long reloading time for muzzleloaders. While the variability of the bullet-propellant charge combination allows for an optimized shot, varying the bullet and in particular the propellant and quantity of propellant can significantly change the appropriate seating depth of the bullet. With loose or powdered propellant such as black powder, the amount of propellant is often varied between 80 and 120 volumetric grains. Similarly, propellants are often formed into cylindrical pellets that are stacked end-to-end within the barrel to form the propellant charges. The pellets are typically each about 1 cm in length and loaded in 1 to 3 pellet groups causing an even greater variation in the seating depth. Variability in the powder and bullet of course causes variability in performance including accuracy.

Another safety concern unique to muzzleloaders is an undersized or oversized propellant charge. Unlike cartridge firearms where the amount of propellant loaded for each shot is limited by the internal volume of the cartridge, theoretically, the amount of propellant loaded for each shot in muzzleloaders is only limited by the length of the barrel. While measures are often used to provide a constant quantity of propellant for each propellant charge, the measures can be difficult to use in the field or in low light situation when hunting often occurs. Similarly, propellant can be formed into the pre-sized pellets that can be loaded one at a time until the appropriate amount of propellant is loaded. As with measuring the quantity of powder, errors can occur in loading the appropriate number of pellets.

SUMMARY OF THE INVENTION

A muzzleloader firearm for use with a projectile, a propellant containment vessel including a prepackaged propellant charge therein, and a primer. The muzzleloader has a stock and a barrel supported by the stock. The barrel has a breech end, a muzzle end, and a barrel wall extending in a forward direction from the breech end to the muzzle end. In embodiments, the barrel wall defining a barrel bore and the barrel wall extends along a centrally located barrel axis of the barrel. In embodiments, the propellant casing and the bullet are dimensioned and configured to be receive by the barrel. In embodiments, a primer is inserted at the breech end, for example with a flashtube, to the propellant containment vessel.

In embodiments, the muzzleloader further includes a breech plug at the rearward cavity of the barrel. In embodiments, the breech plug defines a primer receptacle and a flash tube to the propellant containment vessel in the breech chamber. In embodiments, the firing pin bore is coaxial with the centrally located barrel axis. In embodiments, the barrel is ported toward the muzzle end with a gas channel connecting to the port, extending down the barrel to an inlet port rearward of the propellant containment cartridge. Whereby after firing the muzzleloader, the gas from the port toward the muzzle is pressurized and communicates with the inlet port and expels the empty propellant containment vessel out of the muzzle. In embodiments, the gas pressure transferred to the breech may be regulated by a valve at the port or at the breech.

A feature and benefit of embodiments is a muzzleloader for use with a power cell capsule including a prepackaged propellant charge and a hermetically sealed vessel holding the charge. In embodiments, the vessel is expelled from the muzzleloader by combustion gasses generated by the burning of the propellant charge.

A feature and benefit of embodiments is a muzzleloader for use with a power cell containing a prepackaged charge, a projectile or bullet and a primer. In embodiments, after loading the power cell, the propellant vessel is exposed at the breech end of the barrel by breaking open the muzzleloader, and a primer is inserted into a primer receptacle defined by a propellant vessel. In embodiments, the primer is inserted into a primer receptacle defined by a breech portion of the muzzleloader, such as a breech plug. In embodiments, the primer is mated with a nipple of the muzzleloader.

In embodiments, the propellant vessel may have external features to scrape the barrel as the vessel is being expelled by the tapped combustion gases from the barrel. In embodiments, the propellant vessel has rigid polymer serrations along its circumferential surface. In embodiments, scrapers may comprise metal.

In embodiments, a projectile may be loaded that seats against a forward end of the propellant vessel forcing the propellant vessel rearwardly for proper seating of the propellant vessel and/or the projectile. In embodiments, the projectile may have a bore lock means deployed as it seats.

A feature and benefit of embodiments is a muzzleloader power cell containing a pre-packaged propellant charge that inserted through the muzzle end of the muzzleloader barrel providing efficient loading of the muzzleloader.

A feature and benefit of embodiments is muzzleloader for use with a power cell containing a propellant charge for use with a bullet that is not attached to the power cell. In embodiments, the lack of attachment between the power cell and the bullet may provide increased accuracy when the bullet is fired. In embodiments, the power cell with propellant charge is loaded through the muzzle end of the barrel. A projectile or bullet may then be loaded through the forward, muzzle end of the barrel after loading of the power cell with the propellant charge.

A feature and benefit of embodiments is that the muzzleloader is configured to be used with a propellant containment vessel can that is factory loaded or preloaded with a premeasured propellant charge. In embodiments, a primer is mated to the propellant containment vessel or to the breech portion of the muzzleloader in the field. In embodiments, the loaded containment vessel simplifies the muzzleloader loading process by combining the propellant measuring and loading steps with the primer positioning steps. In embodiments, the containment vessel serves to protect the propellant charge from environmental factors that could impact the ignition of the propellant charge. A feature and advantage of embodiments is that an unfired round may be much more easily unloaded than a conventional muzzleload round. Conventional rounds often require shooting the round which can be problematic. Emptying the powder and projectile through the muzzle can be very difficult and dangerous. In embodiments, the propellant vessel and projectile may be pushed out by way of the primer opening or removal of a breech plug.

A feature and benefit of embodiments is that the muzzleloader is configured and adapted to fire muzzle-loaded projectiles from 45 caliber to 50 caliber.

A feature and benefit of embodiments is a muzzleloader configured to fire a power cell containing a propellant charge sized and adapted to propel a bullet having a weight greater than 200 grains so as to provide a quick/humane kill when hunting. In embodiments, the muzzleloader is configured to fire a power cell containing a propellant charge sized and adapted to propel a bullet having a weight greater than 250 grains. In embodiments, the muzzleloader is configured to fire a power cell containing a propellant charge sized and adapted to propel a bullet having a weight greater than 300 grains.

A feature and benefit of embodiments is a muzzleloader configured to fire a power cell containing a propellant charge for use with primer and a bullet, the muzzleloader system being suitable for use in hunting large game such as elk, moose and bear.

The above summary of the various representative embodiments is not intended to describe each illustrated embodiment or every implementation of the invention. Rather, the embodiments are chosen and described so that others skilled in the art can appreciate and understand the principles and practices of the invention. The Figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which:

FIG. 1 is a side elevation view of a muzzleloader in accord with embodiments.

FIG. 2 is a partial cross-sectional view of the firearm of FIG. 1.

FIG. 3 is an elevation view of a propellant vessel in accord with embodiments.

FIG. 4 is an elevation view with a broken off portion of an embodiment of a propellant vessel with propellant.

Figure 5:
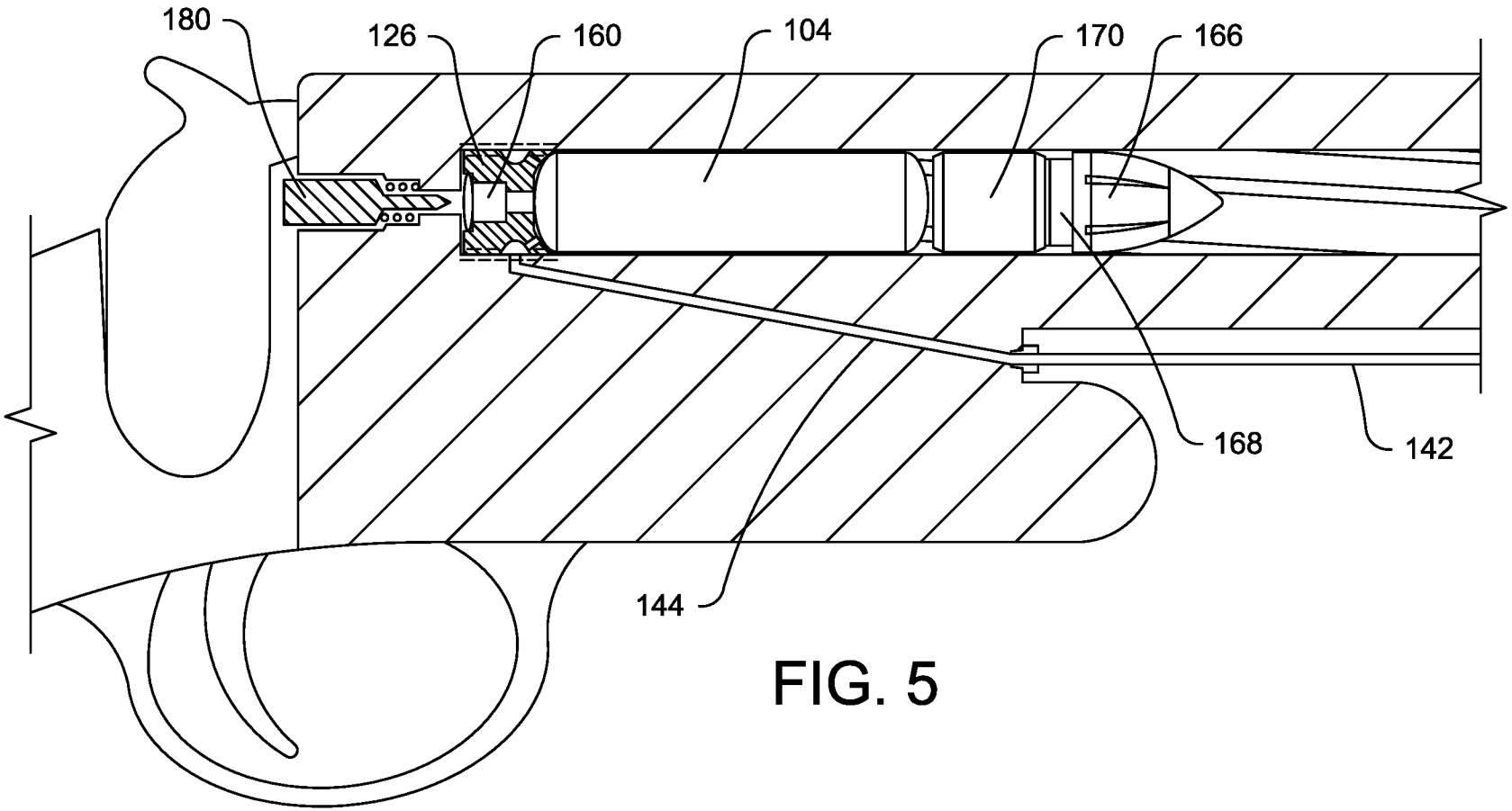
FIG. 5 is the cross sectional view of the muzzleloader of FIG. 2 loaded.

While the invention is amenable to various modifications and alternative forms, specifics thereof have been depicted by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE INVENTION

Referring to FIGS. 1-4, a muzzleloader 100 is configured for use with a propellant vessel 104 containing a prepackaged propellant charge 106. The muzzleloader 100 may have a stock 110 and a barrel 112 supported by the stock 110, a receiver 113. In embodiments, the barrel 112 has a breech end 114, a muzzle end 116, and a barrel wall 118 extending from the breech end 114 to the muzzle end 116. In embodiments, the barrel wall 118 defines a barrel bore 120 and the barrel wall 118 extends along a centrally located barrel axis 122 of the barrel 112. In embodiments, the barrel bore 120 is dimensioned and configured to receive the propellant containing vessel 104 and a specific sized projectile 166 wherein a projectile 166 is configured to be received in a projectile receiving region 188 of barrel 112 forward of a propellant chamber 132 configured to receive propellant containing vessel 104. In embodiments, a breech plug 126 may be received in the breech end 114 of the barrel 112. In certain embodiments, breech plug 126 is attached to barrel 112 by a threaded connection, or by welding, screws or some other means of retaining the breech plug 126. In other embodiments, breech plug 126 is not attached to barrel 112.

Still referring to FIGS. 1-4, the breech plug 126 defines a primer receptacle 128 with a flash tube 130 extending to the propellant chamber 132 immediately forward of the breech plug 126. In embodiments, the barrel 112 has a gas port 140 with a gas tube 142 extending rearwardly. The gas tube 142 communicates by a passageway 144 in stock 110 to an annular gas passageway 184 in breech plug 126. The breech plug 126 defining passageways with outlets 146 leading from annular gas passageway 184 to the propellant chamber 132. In embodiments, the gas from the gas port 140 may be conveyed through other means than as described. The propellant vessels 104 may have surface treatment or other external scraping features 151 added to provide a scraping effect as the propellant vessel 104 passes through the barrel 112. For example, propellant vessel 104 may have external scraping features 151 configured to scrape the barrel bore 120 as the propellant vessel 104 is being expelled by the tapped combustion gases from barrel 112 as discussed below. In embodiments, propellant vessel 104 may include a polymeric containment portion 190 with propellant 106 hermetically sealed within the polymeric containment portion 190. In embodiments, external scraping features 151 may comprise metal. In embodiments, external scraping features 151 may be rigid polymer serrations along the circumferential surface of propellant vessel 104 having a polymeric containment portion. The external scraping features 151 in the form of rigid polymer serrations may be more rigid that the polymer of the containment portion wherein when propellant vessel 104 is ejected the external scraping features 151 scrape the barrel bore 120 cleaning crud therefrom.

Figure 6:
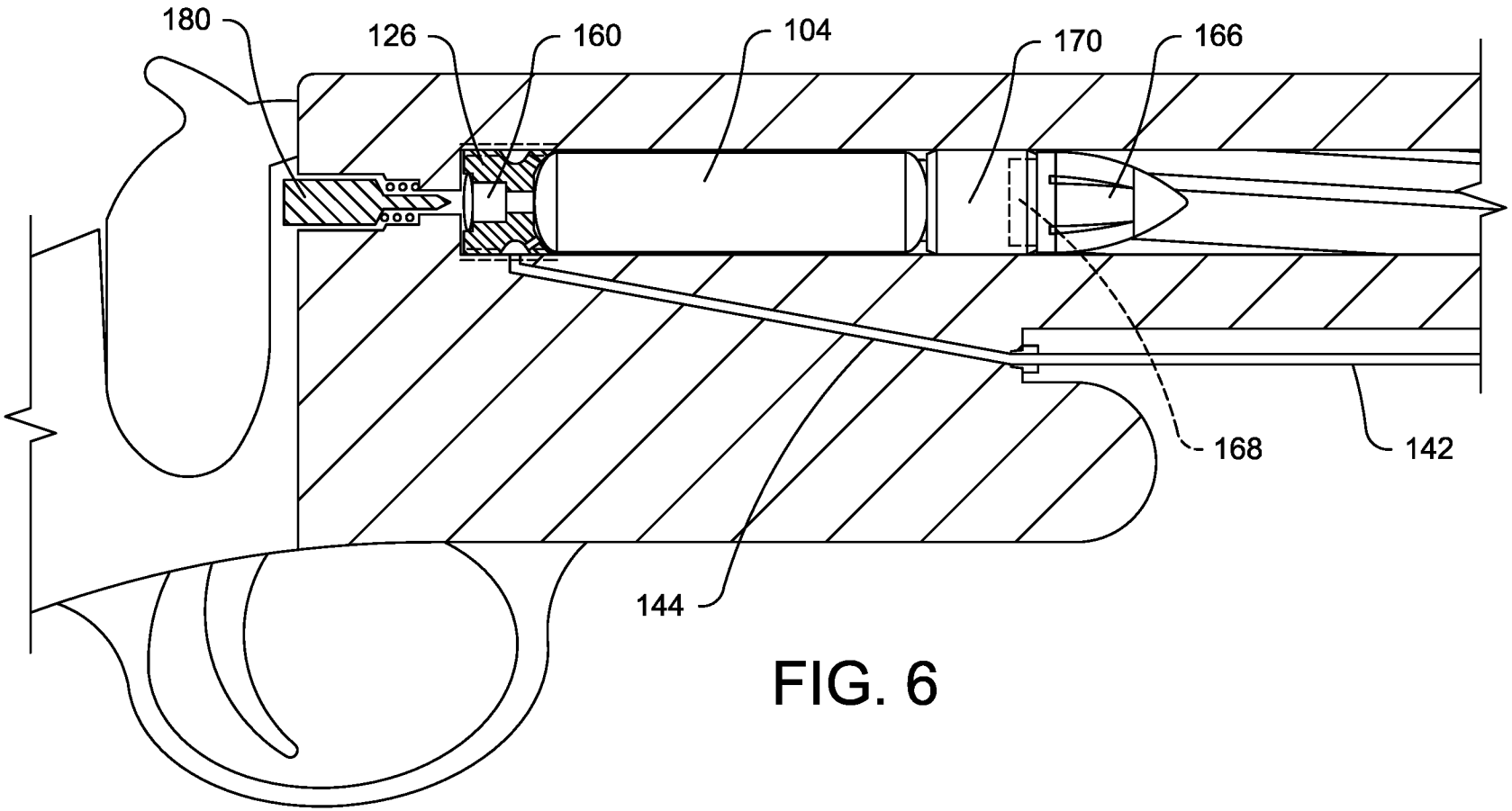
FIG. 6 is the cross sectional view of the muzzleloader of FIG. 5 with the projectile axially compressed, radially expanded, and locked in the barrel.
Figure 7:
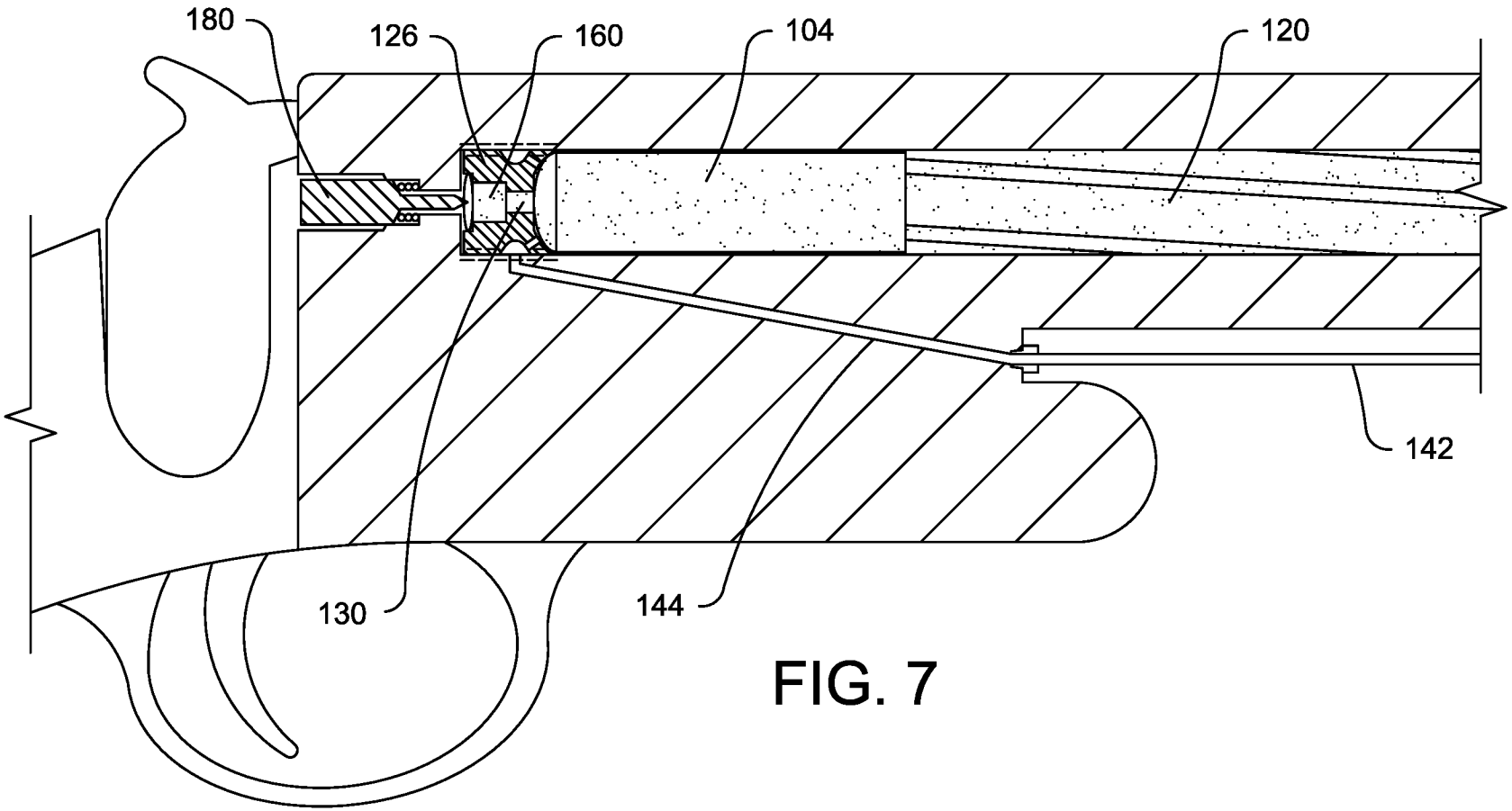
FIG. 7 is the cross sectional view of the muzzleloader of FIG. 6 being fired.
Figure 8:
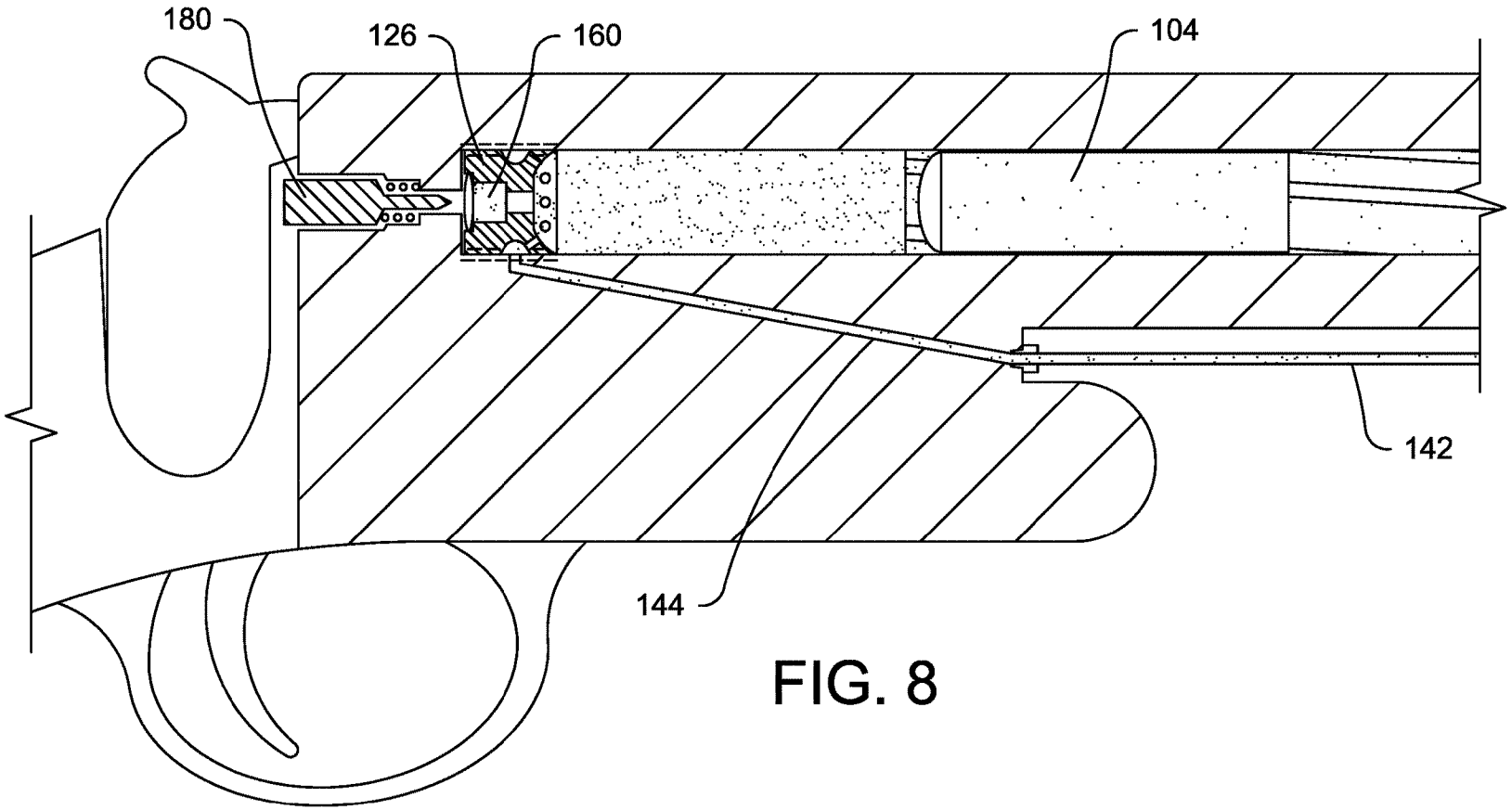
FIG. 8 is the cross sectional view of the muzzleloader of FIG. 7 with expanding propellant gasses moving the propellant vessel down the barrel.
Figure 9:
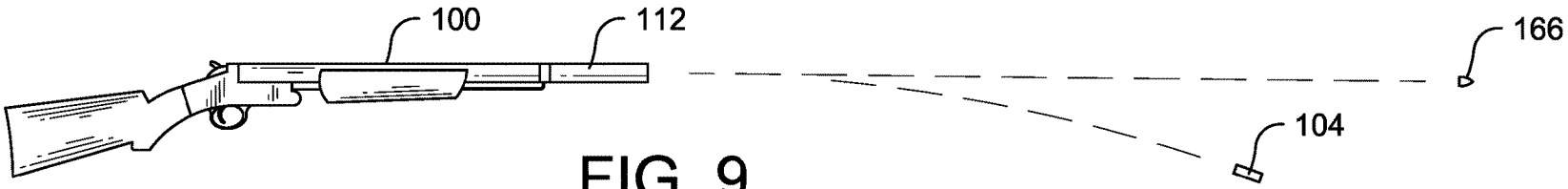
FIG. 9 is the muzzleloader of FIG. 8 showing the ejection of the propellant vessel.

Referring to FIGS. 5-9, the muzzleloader is loaded with a propellant vessel 104, a primer 160, and a projectile 166 having a projectile body 168 and a sleeve 170. The projectile 166 may be as disclosed in U.S. Pat. Nos. 9,562,754 and 9,146,086, and 10,030,956. These patents are incorporated herein by reference for all purposes. In embodiments not pictured, breech end 114 of barrel 112 may be configured such that primer receptacle 128 is accessible by the user at the breach end to insert a primer 160, by means of an opening or a hinge action in the receiver 113. Axial pressure, such as by a ramrod, may cause the telescoping compression of the projectile body 168 within sleeve 170 effecting a radial expansion of the sleeve 170, as shown in FIG. 6, thereby locking the projectile 166 and the propellant vessel 104 in place in barrel bore 120. In embodiments, axial pressure on projectile 166 compresses projectile 166 and sleeve 170 together by shifting projectile 166 such that projectile body 168 compressibly slides within sleeve 170 and sleeve 170 slides onto projectile body 168 radially expanding sleeve 170 against barrel bore 120. In FIG. 7, the firing pin 180 strikes the primer 160 which ignites the primer propellant of primer 160 and sends expanding primer gases down the flash tube 130 within breech plug 126 to the propellant chamber 132 and to the propellant vessel 104 breaching propellant vessel 104. The propellant vessel 104 may have a thinned wall at a rearward flash tube interface 182 allowing it to be more easily penetrated. The propellant 106 in the propellant vessel 104 is ignited creating expanding gas which opens propellant vessel end 186 and fires the projectile 166 down the barrel 112. As the projectile 166 passes the gas port 140 the expanding gasses travel down barrel 112, are transferred back to the breech plug 126 and discharged behind the propellant vessel 104. The projectile 166 having left the barrel 112 has a lower gas pressure forward of the propellant vessel 104 and the propellant vessel 104 gets pushed down and out of the barrel 112 as shown in FIGS. 8 and 9.

Figure 10:
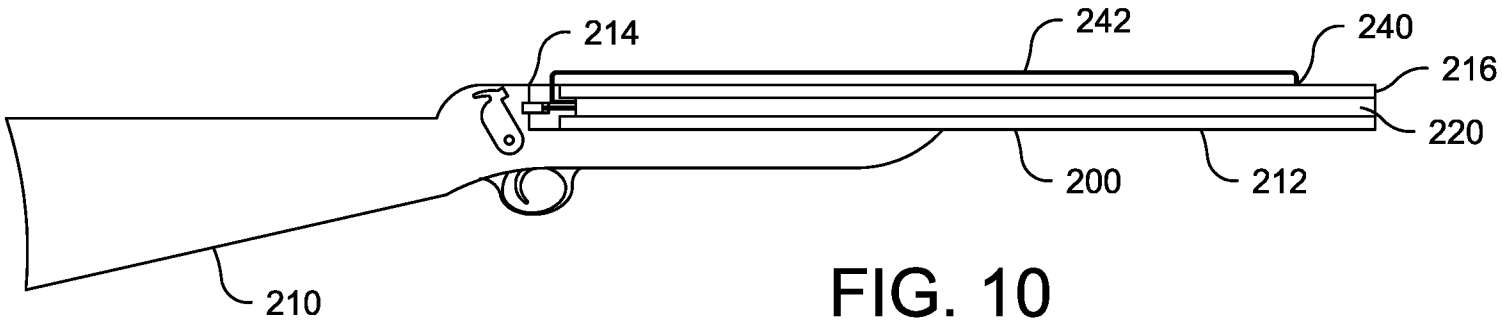
FIG. 10 is a side elevation view of a muzzleloader in accord with embodiments.
Figure 11:
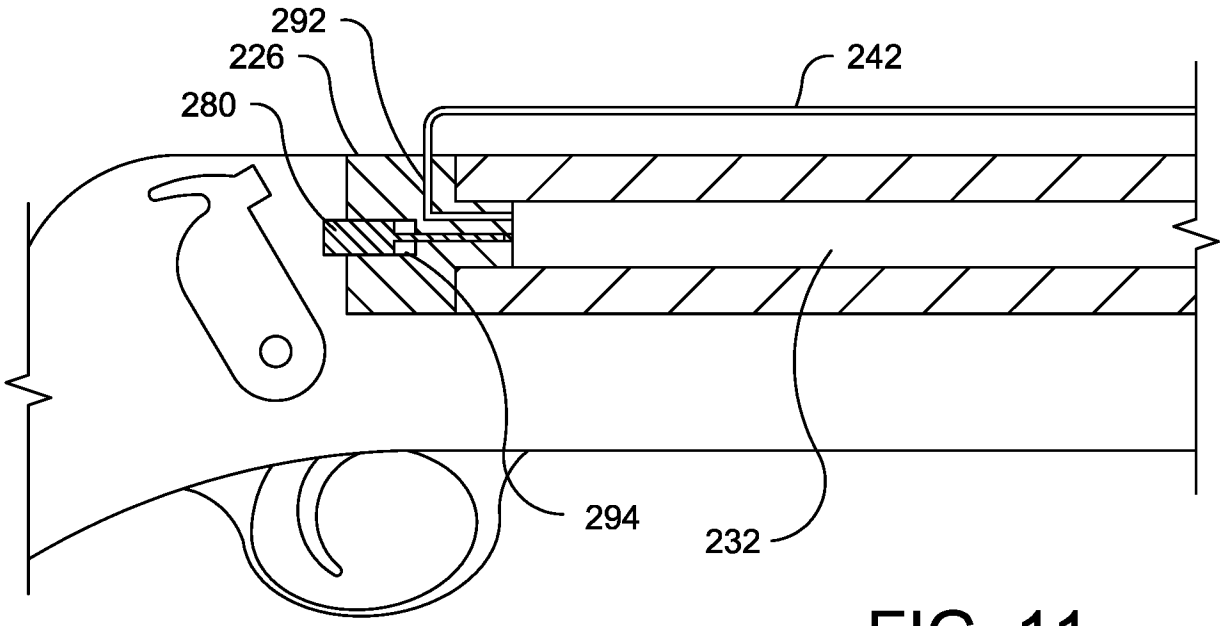
FIG. 11 is a partial cross-sectional view of the firearm of FIG. 10.
Figure 12:
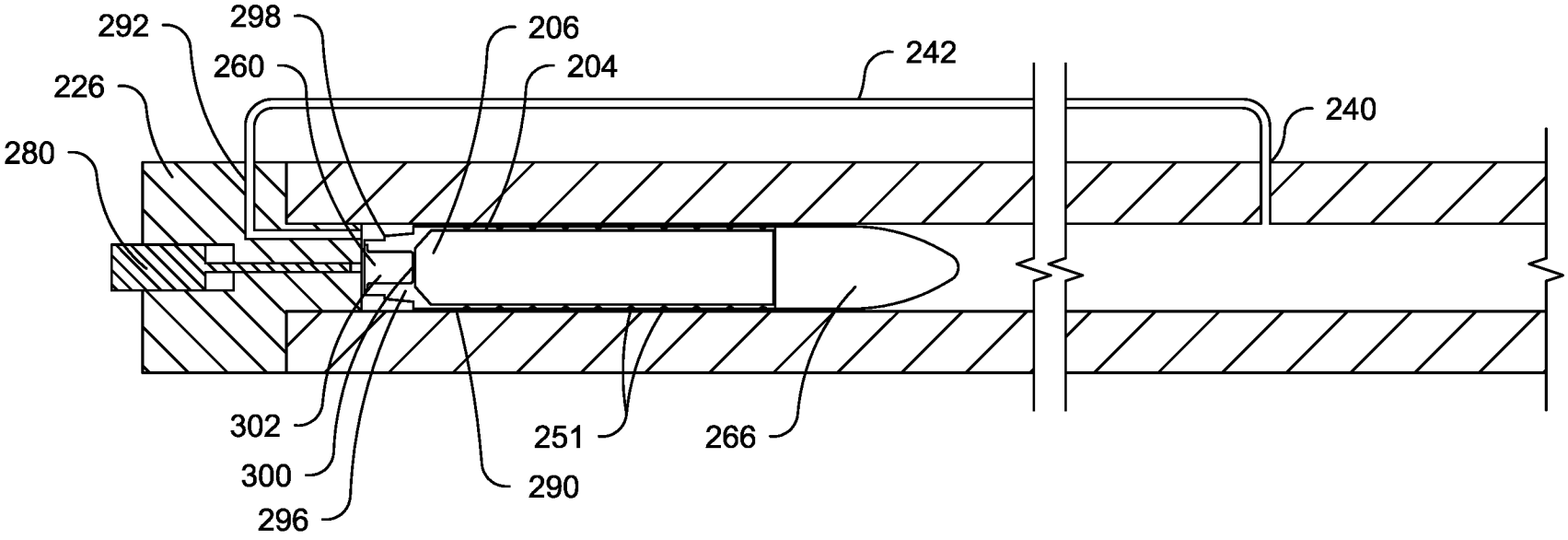
FIG. 12 is a partial cross-sectional detail view of the firearm of FIG. 10.

Referring to FIGS. 10-12, wherein like or similar features are referenced by reference numerals increased by one hundred, a muzzleloader 200 is configured for use with a propellant vessel 204 containing a prepackaged propellant charge 206. The muzzleloader 200 may have a stock 210 and a barrel 212. In embodiments, the barrel 212 has a breech end 214, a muzzle end 216 and a barrel bore 220. In embodiments, the barrel bore 220 is dimensioned and configured to receive propellant containing vessel 204 and a specific sized projectile 266 wherein a propellant chamber 232 of barrel bore 220 is configured to receive propellant containing vessel 204. In embodiments, a breech plug 226 is disposed in the breech end 214 of barrel 212. In embodiments, barrel 212 has a gas port 240 with a gas tube 242 extending rearwardly.

Still referring to FIGS. 10-12, breech plug 226 defines a passageway 292 between gas tube 242 and propellant chamber 232. Breech plug 226 further defines a receptacle 294 for a firing pin 280.

In embodiments, the propellant containment vessel 204 may comprise a containment portion 290 and a cap 296 with a primer receptacle 302. In certain embodiments, containment portion 290 and cap 296 are unitary, making up propellant containment vessel 204. In those embodiments, the containment portion 290 and cap 296 are ejected from the bore together after firing. Unlike other embodiments disclosed herein, in this embodiment the primer is contained in the propellant containment vessel 204, and all expendable components needed to fire the muzzleloader are ejected from the bore after each shot. In this manner, nothing else needs to be removed from the muzzleloader after a shot in order to prepare and load the muzzleloader for the next shot. In some embodiments, cap 296 may have a rear facing annular shoulder 298 which receives gas pressure from passageway 292 for ejecting propellant containment vessel 204 and cap 296. Containment portion 290 may also have external scraping features 251.

The cap may have a closure for sealing the propellant 206 in the propellant vessel 204 prior to use to maintain the integrity and to securely contain the propellant 206. A web 300 that is unitary with the polymer cap 296 may be a suitable enclosure. Such a web 300 may be punctured by a suitably configured primer 260 or it may be breeched by the firing of the primer 260. Alternatively a closure may be externally accessed by the user to remove same prior to insertion of the primer 260.

The following United States patents are hereby incorporated by reference herein in their entirety except for patent claims and express definitions contained therein: U.S. Pat. Nos. 9,273,941; 9,261,335; 9,003,973; 8,875,633; 8,869,702; 8,763,535; 8,726,560; 8,590,199; 8,573,126; 8,561,543; 8,453,367; 8,443,730; 8,240,252; 8,146,505; 7,984,668; 7,621,208; 7,444,775; 7,441,504; 7,278,358; 7,225,741; 7,059,234; 6,931,978; 6,845,716; 6,752,084; 6,625,916; 6,564,719; 6,439,123; 6,178,889; 5,677,505; 5,492,063; 5,359,937; 5,216,199; 4,955,157; 4,169,329; 4,098,016; 4,069,608; 4,058,922; 4,057,003; 3,776,095; and 3,771,415. Components illustrated in the incorporated by reference references may be utilized with embodiments herein.

All of the features disclosed, claimed, and incorporated by reference herein, and all of the steps of any method or process so disclosed, may be combined in any combination, except combinations where at least some of such features and/or steps are mutually exclusive. Each feature disclosed in this specification may be replaced by alternative features serving the same, equivalent or similar purpose, unless expressly stated otherwise. Thus, unless expressly stated otherwise, each feature disclosed is an example only of a generic series of equivalent or similar features. Inventive aspects of this disclosure are not restricted to the details of the foregoing embodiments, but rather extend to any novel embodiment, or any novel combination of embodiments, of the features presented in this disclosure, and to any novel embodiment, or any novel combination of embodiments, of the steps of any method or process so disclosed.

Although specific examples have been illustrated and described herein, it will be appreciated by those of ordinary skill in the art that any arrangement calculated to achieve the same purpose could be substituted for the specific examples disclosed. This application is intended to cover adaptations or variations of the present subject matter. Therefore, it is intended that the invention be defined by the attached claims and their legal equivalents, as well as the illustrative aspects. The above described embodiments are merely descriptive of its principles and are not to be considered limiting. Further modifications of the invention herein disclosed will occur to those skilled in the respective arts and all such modifications are deemed to be within the scope of the inventive aspects.

What is claimed is:

1. A muzzleloader firearm configured for use with a projectile, a primer, and a propellant vessel containing a propellant, comprising:

a stock;

a barrel supported by the stock, the barrel having a barrel wall defining a barrel bore with a barrel axis, the barrel having a breech end and a muzzle end, a breech plug in the breech end, a propellant chamber forward of the breech plug and a projectile receiving region forward of the propellant chamber, the barrel having a gas port toward the muzzle end, a gas conduit extending from the gas port to the breech plug, wherein the propellant chamber is configured to receive the propellant vessel, and wherein the projectile receiving region is configured to receive the projectile;

the breech plug having a gas passageway connecting to the gas conduit, with at least one gas outlet leading to the propellant chamber, wherein the muzzleloader is configured to be fired with the primer loaded in a primer receptacle and the propellant vessel in the propellant chamber and the projectile forward of the propellant vessel in the projectile receiving region, wherein the gas port is configured to receive gases created by the propellant, wherein the gas conduit is configured to transfer the gases from the gas port to the breech plug, wherein the breech plug is configured to transfer the gases through the gas passageway and the at least one outlet to the propellant chamber behind the propellant vessel to eject the propellant vessel from the barrel.

2. The muzzleloader firearm of claim 1, wherein the breech plug further comprises the primer receptacle facing rearwardly and configured to receive the primer, the breech plug defining a flash tube extending directly from the primer receptacle to the propellant chamber.

3. The muzzleloader firearm of claim 1, further in combination with the propellant vessel, wherein the propellant vessel further comprises the primer receptacle facing rearwardly and configured to receive the primer.

4. The muzzleloader firearm of claim 1, further in combination with the projectile, wherein the projectile has a radially expandable sleeve that is configured to lock the propellant vessel in the propellant chamber.

5. The muzzleloader firearm of claim 1, further in combination with the propellant vessel, wherein the propellant vessel that has a polymeric containment portion and a plurality of exterior scraping portions that comprise a material which is more rigid than the polymeric containment portion and configured to scrape the barrel wherein when the propellant vessel is ejected.

6. A method of firing a muzzleloader comprising:

loading a propellant vessel having propellant sealed therein, loading a projectile forward of the propellant vessel;

loading a primer in a breech region of the muzzleloader;

pulling a trigger thereby striking the primer with a firing pin, directing primer gas to the propellant vessel, breaching the propellant vessel by the primer gas, igniting the propellant creating expanding propellant gas, launching the projectile with the expanding propellant gas, tapping the expanding gas from the barrel and transferring the expanding gas to the propellant vessel chamber behind the propellant vessel, and ejecting the propellant vessel.

7. The method of claim 6, further comprising scraping a barrel wall of the muzzleloader with scraping portions on the propellant vessel as the propellant vessel is ejected.

8. The method of claim 7, further comprising locking the propellant vessel filled with propellant behind the projectile having a projectile sleeve and a projectile body prior to pulling the trigger by compressing the projectile and the projectile sleeve thereby shifting the projectile sleeve on the projectile such that the projectile sleeve slides onto the projectile body radially expanding the sleeve.

* * * * *